US008256764B2

(12) United States Patent
Imoto

(10) Patent No.: US 8,256,764 B2
(45) Date of Patent: Sep. 4, 2012

(54) IMAGE FORMING APPARATUS WITH PAPER PRESSING MEMBER

(75) Inventor: Shinji Imoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 277 days.

(21) Appl. No.: 11/996,566

(22) PCT Filed: May 22, 2007

(86) PCT No.: PCT/JP2007/060753

§ 371 (c)(1),
(2), (4) Date: Jan. 23, 2008

(87) PCT Pub. No.: WO2007/139043

PCT Pub. Date: Dec. 6, 2007

(65) Prior Publication Data

US 2009/0121422 A1 May 14, 2009

(30) Foreign Application Priority Data

May 26, 2006 (JP) ..... 2006-146861
Mar. 14, 2007 (JP) ..... 2007-065640

(51) Int. Cl.
*B65H 29/70* (2006.01)

(52) U.S. Cl. ..... 271/188

(58) Field of Classification Search ..... 271/188
See application file for complete search history.

(56) References Cited

U.S. PATENT DOCUMENTS 5,409,209 A * 4/1995 Nakamura et al. ..... 271/271
5,874,979 A * 2/1999 Ohyama ..... 271/188
5,904,350 A * 5/1999 Creighton et al. ..... 271/227
7,021,757 B2 * 4/2006 Kida ..... 271/186
7,232,269 B2 * 6/2007 Ohyama ..... 271/188

FOREIGN PATENT DOCUMENTS

| | | | |
|---|---|---|---|
| JP | 59-188467 | | 10/1984 |
| JP | 63-68666 | | 5/1988 |
| JP | 7-10311 | | 1/1995 |
| JP | 7-125364 | | 5/1995 |
| JP | 7-132659 | | 5/1995 |
| JP | 9-24650 | | 1/1997 |
| JP | 09024650 | A * | 1/1997 |
| JP | 9-48161 | | 2/1997 |
| JP | 09048161 | A * | 2/1997 |
| JP | 2616407 | | 3/1997 |
| JP | 11-138923 | | 5/1999 |

(Continued)

OTHER PUBLICATIONS

May 25, 2009 European search report in connection with a counterpart European patent application No. 07 74 4187.

*Primary Examiner* — Gerald McClain
(74) *Attorney, Agent, or Firm* — Cooper & Dunham LLP

(57) ABSTRACT

A sheet of paper is conveyed by a convey roller to a print receiving member and pushed forward thereon while being supported by ribs and pressed downward by pressing members so as to keep a predetermined distance between the paper and a recording head while an image is printed on the paper. Since the pressing members press respective side portions of the paper, the paper can be bent downward outside the outmost ribs and prevented from rising at the side portions.

19 Claims, 20 Drawing Sheets

FOREIGN PATENT DOCUMENTS

| | | | | |
|---|---|---|---|---|
| JP | 11138923 | A | * | 5/1999 |
| JP | 2000-71532 | | | 3/2000 |
| JP | 2000071532 | A | * | 3/2000 |
| JP | 2001-261188 | | | 9/2001 |
| JP | 2002-36649 | | | 2/2002 |
| JP | 2004-90538 | | | 3/2004 |
| JP | 2004-322632 | | | 11/2004 |
| JP | 2005-314064 | | | 11/2005 |

* cited by examiner

IMAGE FORMING APPARATUS WITH PAPER PRESSING MEMBER

CROSS REFERENCE TO RELATED APPLICATION

This disclosure is based on Japanese Patent Applications Nos. 2006-146861 and 2007-065640, filed on May 26, 2006 and Mar. 14, 2007, respectively, with the Japanese Patent Office.

TECHNICAL FIELD

This disclosure relates to a paper conveying apparatus, an image forming apparatus and an ink-jet recording apparatus; more particularly to a paper conveying apparatus, an image forming apparatus and an ink-jet recording apparatus that have a print receiving member arranged opposed to a print head.

BACKGROUND ART

Conventionally, an ink-jet recording apparatus used as an image recording apparatus (image forming apparatus) such as a printer, a facsimile, a copier or the like can form an image on a sheet of paper (not necessarily limited to paper but whatever is used to form an image thereon) by ejecting ink droplets from a nozzle of an ink-jet head thereto. Since deviation of the positional relationship between the sheet of paper and the ink-jet head may degrade image quality, it is required to convey the sheet of paper with accuracy.

Since the ink-jet recording apparatus allows ink droplets to adhere on a sheet of paper, the paper tends to become corrugated. Namely, within a few seconds after the ink droplets adhere on the paper, the paper swells and then becomes corrugated, which is known as so-called cockling. Typically, when an image is printed on a sheet of paper, there are margins formed on the right, left, top, and bottom of the paper. Therefore, tensile stress is caused between the right (left) margin and a printed area adjacent to the right (left) margin, which pulls both the margins inward, thereby causing both side portions of the paper to rise. If this happens, the paper cannot be flat in relation to the ink-jet head, and a gap between the paper and the ink-jet head varies, thereby distorting the image. Moreover, a large corrugation of the paper causes a problem in that the image printed on the paper may be defective and the ink-jet head may be damaged or broken since the paper can contact the ink-jet head.

In order to eliminate such disadvantages, an image forming apparatus such as an ink-jet printer has been proposed in recent years, where a conveyor roller is disposed in both the upstream and the downstream end of a paper conveying direction so as to maintain the flatness of the paper in relation to the ink-jet head. Such an image forming apparatus can prevent the paper from becoming corrugated during printing (See, patent-related publications listed below).

[Patent-related document 1] Japanese Patent Application Laid-Open Publication No. H7-125364.

[Patent-related document 2] Japanese Patent Application Laid-Open Publication No. H7-132659.

[Patent-related document 3] Japanese Patent Application Laid-Open Publication No. H9-24650.

[Patent-related document 4] Japanese Patent Application Laid-Open Publication No. 2001-261188.

However, in such an ink jet recording apparatus where the conveyor rollers are provided in the upstream and the downstream end of the paper along the conveying direction, an image is printed on the paper while the conveyer rollers are holding the leading and the rear ends of the paper. Therefore, a relatively larger non-printed zone has to be allocated at the upper and lower portions of the paper (i.e., the leading margin and the rear margin), which leads to another problem in that the printable area becomes smaller.

The present invention has been made in view of the above, and may provide a paper conveying apparatus, an image forming apparatus and an ink-jet recording apparatus that can press side portions of paper downward so as to allow the paper to bend downward.

SUMMARY

In an aspect of this disclosure, there is provided a paper conveying apparatus including a first paper pressing member configured to press one side portion of a sheet of paper that may be conveyed therethrough, the side portion extending along a paper conveying direction.

In another aspect of this disclosure, the first paper pressing member is disposed so that a downstream portion thereof along the paper conveying direction lies outward in a direction transverse to the paper conveying direction from an upstream portion thereof.

In another aspect of this disclosure, the first paper pressing member is disposed so that a center of a downstream portion thereof along the paper conveying direction lies outward in a direction transverse to the paper conveying direction from a center of an upstream portion thereof.

In another aspect of this disclosure, the first paper pressing member is disposed so that a center of a downstream portion thereof along the paper conveying direction lies outward in a direction transverse to the paper conveying direction from a corresponding one edge of the sheet of paper.

In another aspect of this disclosure, the first paper pressing member is disposed so that a middle portion thereof between a downstream portion thereof and an upstream portion thereof along the paper conveying direction lies outward from a corresponding one edge of the sheet of paper.

In another aspect of this disclosure, the first paper pressing member becomes narrower toward a downstream end thereof along the paper conveying direction.

In another aspect of this disclosure, the paper conveying apparatus further includes one or more supporting members configured to support the sheet of paper from below.

In another aspect of this disclosure, the paper conveying apparatus further includes a second paper pressing member configured to press the other side portion of the sheet of paper.

In another aspect of this disclosure, the second paper pressing member is symmetric in shape with the first paper pressing member in relation to the paper conveying direction.

In another aspect of this disclosure, the paper conveying apparatus further includes one or more third paper pressing members capable of pressing the sheet of paper between the first and the second paper pressing members.

In another aspect of this disclosure, the first or the second paper pressing member presses one side portion of the sheet of paper and one of the one or more third paper pressing members presses the other side portion of the sheet of paper, and where the one of the one or more third paper pressing members is disposed symmetrically with the first or the second paper pressing member in relation to the paper conveying direction.

In another aspect of this disclosure, the paper conveying apparatus further includes one or more paper pressing amount limiting members disposed below the sheet of paper and configured to be substantially vertically movable so as to limit an amount of pressing on the sheet of paper caused by the first paper pressing member, the second paper pressing member, the third paper pressing member, or a combination thereof.

In another aspect of this disclosure, the paper conveying apparatus further includes one or more supporting members configured to support the sheet of paper from below, where the one or more paper pressing amount limiting members push from below the sheet of paper that is held from below by the supporting member and pressed from above by the first paper pressing member, the second paper pressing member, the third paper pressing member, or a combination thereof, so as to limit the amount of pressing from above.

In another aspect of this disclosure, each of the one or more third paper pressing members is disposed between every adjacent two of the supporting members, and wherein one of the one or more supporting members, the corresponding one of the one or more paper pressing amount limiting members, and the corresponding one of the one or more third paper pressing members are disposed in this order in a direction transverse to the paper conveying direction.

In another aspect of this disclosure, each of the one or more third paper pressing members is disposed between every adjacent two of the supporting members, and wherein one of the one or more third paper pressing members, the corresponding one of the one or more supporting members, and the corresponding one of the one or more paper pressing amount limiting members are disposed in this order in a direction transverse to the paper conveying direction.

In another aspect of this disclosure, each of the one or more paper pressing amount limiting members is disposed below a corresponding one of the one or more third paper pressing members.

In another aspect of this disclosure, one of the one or more paper pressing amount limiting members is disposed between the first paper pressing member and the third paper pressing member adjacent to the first paper pressing member.

In another aspect of this disclosure, one of the one or more paper pressing amount limiting members is disposed between the second paper pressing member and the third paper pressing member adjacent to the second paper pressing member.

In another aspect of this disclosure, at least one of the one or more paper pressing amount limiting members is disposed outward in a direction transverse to the paper conveying direction from a corresponding edge of the sheet of paper.

In another aspect of this disclosure, a first set of the one or more paper pressing amount limiting members is disposed below the corresponding third paper pressing members and where a second set of the one or more paper pressing amount limiting members is disposed between every adjacent two of the third paper pressing members.

In another aspect of this disclosure, the paper conveying apparatus further includes a print receiving member disposed opposing a print head that prints on the sheet of paper; a conveying roller configured to convey the sheet of paper to the print receiving member; and a pressing roller configured to press the sheet of paper on the conveying roller, where at least one of the first, the second, and the third paper pressing members is configured to press the sheet of paper on the print receiving member.

In another aspect of this disclosure, the paper conveying apparatus further includes one or more supporting members disposed on the print receiving member so as to support the sheet of paper from below.

In another aspect of this disclosure, there is provided an image forming apparatus comprising at least the paper conveying apparatus.

In another aspect of this disclosure, there is provided an ink jet recording apparatus comprising at least the paper conveying apparatus.

In another aspect of this disclosure, there is provided a paper conveying apparatus, an image forming apparatus and an ink-jet recording apparatus that can press side portions of paper downward so as to allow the paper to bend downward.

BEST MODE FOR CARRYING OUT THE INVENTION

Referring to the accompanying drawings, a paper conveying apparatus, an image forming apparatus and an ink jet recording apparatus according to embodiments of the present invention are described hereinafter. Since the following embodiments are illustrated only as preferred embodiments of the present invention, technologically preferable limitations are added thereto. However, the present invention is not limited to the embodiments disclosed herein unless a particular limitation is recited in the following description.

[Ink-jet Recording Apparatus]

Figure 1:
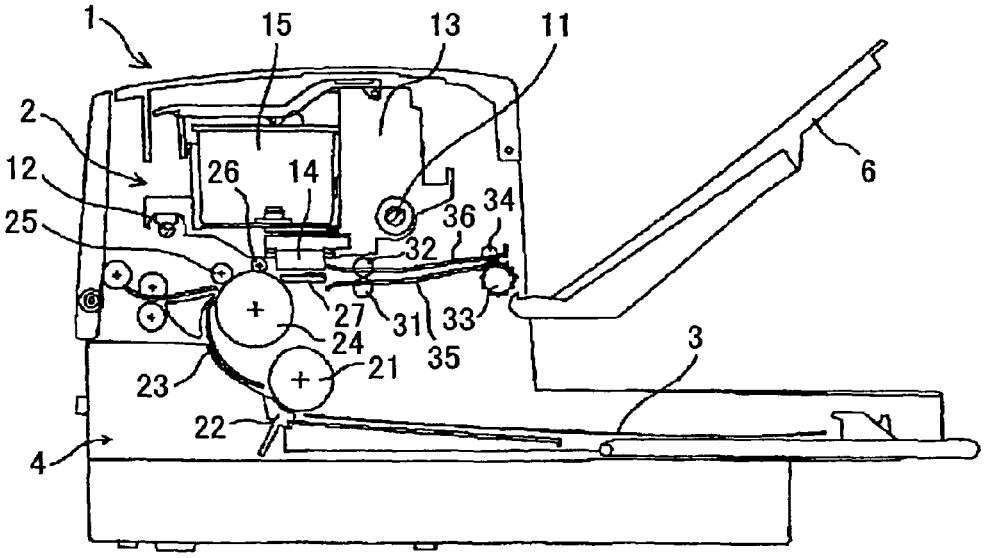
FIG. 1 is a schematic cross-sectional view of an ink-jet recording apparatus according to an embodiment of the present invention.

FIG. 1 is a schematic cross-sectional view of an ink-jet recording apparatus according to one embodiment of the present invention. The recording apparatus houses a printing mechanism portion 2 configured to have a carriage 13 movable along the main scanning direction (perpendicular to the paper surface of FIG. 1) in a recording apparatus body 1, a recording head 14 composed of an ink-jet head mounted on the carriage 13, and an ink cartridge 15 configured to supply ink to the recording head 14, or the like. The details thereof are described hereinafter.

In the lower portion of the recording apparatus body 1, a paper feed cassette 4 into which plural sheets of paper 3 can be placed from the front portion thereof is removably loaded. By the way, the paper 3 can be fed from a paper feed tray (not shown) instead of the paper feed cassette 4.

The paper 3 that has once been placed in the paper feed cassette 4 is conveyed through a path defined by a paper feed roller 21 and a friction pad 22 which can cooperatively separate one sheet of paper 3 from other sheets of paper 3 in the paper feed cassette 4, a conveyance roller 24 which reverses the direction of the paper 3 conveyed from the paper feed cassette 4 to feed the paper 3 forward, and a conveyance roller 26 that defines an ejection angle of the paper 3 that has been ejected from the conveyance roller 24 and an associated conveyance roller 25 that is disposed pressed toward the circumferential surface of the conveyance roller 24. Having traveled through this path, the paper 3 finally reaches the printing mechanism portion 2.

The printing mechanism portion 2 is composed of the carriage 13, the recording head 14, and the ink tank 15, or the like, and functions to print the paper 3.

The carriage 13 is held by a main guide rod 11 and a sub guide rod 12 supported by right and left side plates (not shown) so as to slidably move in the main scanning direction (perpendicular to the paper surface of FIG. 1).

The recording head 14 is mounted on the undersurface of the carriage 13 so as to eject ink droplets downward. The recording head 14 is composed of the ink-jet head having nozzles for ejecting ink droplets of yellow (Y), cyan (C), magenta (M), and black (Bk). By the way, the recording head 14 may be composed of plural heads that are disposed side-by-side in the main scanning direction and eject ink droplets of respective colors. In addition, the recording head 14 may be composed of one head having nozzles capable of ejecting ink droplets of corresponding colors.

Below the recording head 14, a print receiving member 27 is arranged as a guide configured to guide the paper 3.

The ink tank (ink cartridge) 15 is configured to supply ink of each color to the corresponding recording head 14. The ink tank 15 is replaceably mounted on the carriage 13.

On the paper 3 conveyed to the printing mechanism portion 2 is printed an image by the recording head 14, and then the paper 3 with the image thereon is further conveyed to a paper ejection tray 6 by a configuration described below.

Downstream from the print receiving member 27 along the paper conveying direction (or along the rightward direction in FIG. 1), a conveyor roller 31 and a spur 32 are arranged for conveying forward (or rightward) the paper 3. Additionally, downstream from the conveyor roller 31 and the spur 32, guide members 35, 36 are arranged so as to define a paper ejection path. Furthermore, downstream therefrom, a paper ejection roller 33 and a spur 34 are arranged for conveying the paper 3 toward the paper ejection tray 6.

[Print Receiving Member 27]

Figure 2:
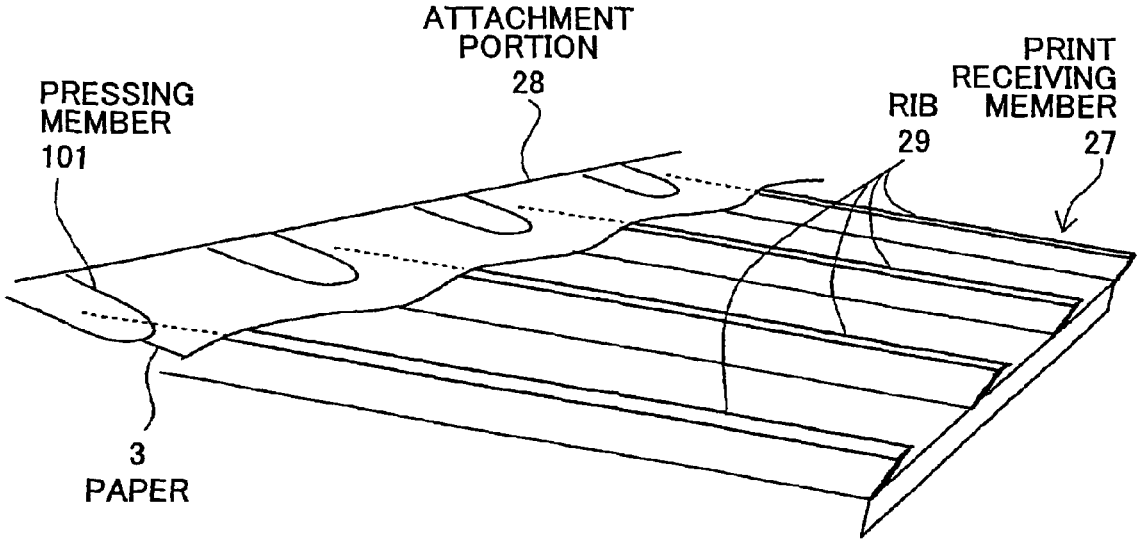
FIG. 2 is a schematic perspective view of a print receiving member and the vicinity thereof in the ink-jet recording apparatus according to the embodiment of the present invention.
Figure 3:
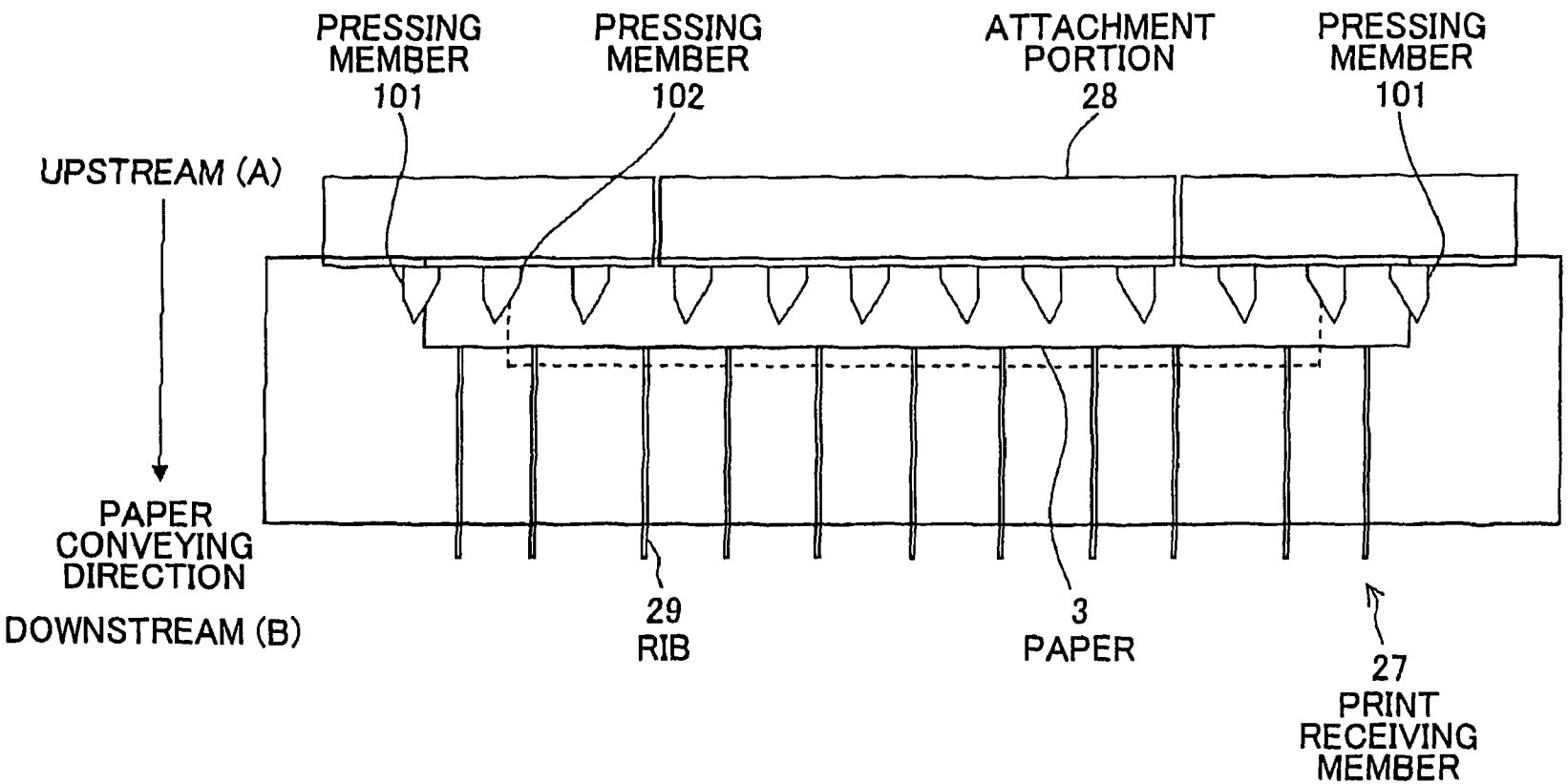
FIG. 3 is a plan view of the print receiving member of the ink-jet recording apparatus according to the embodiment of the present invention.
Figure 4:
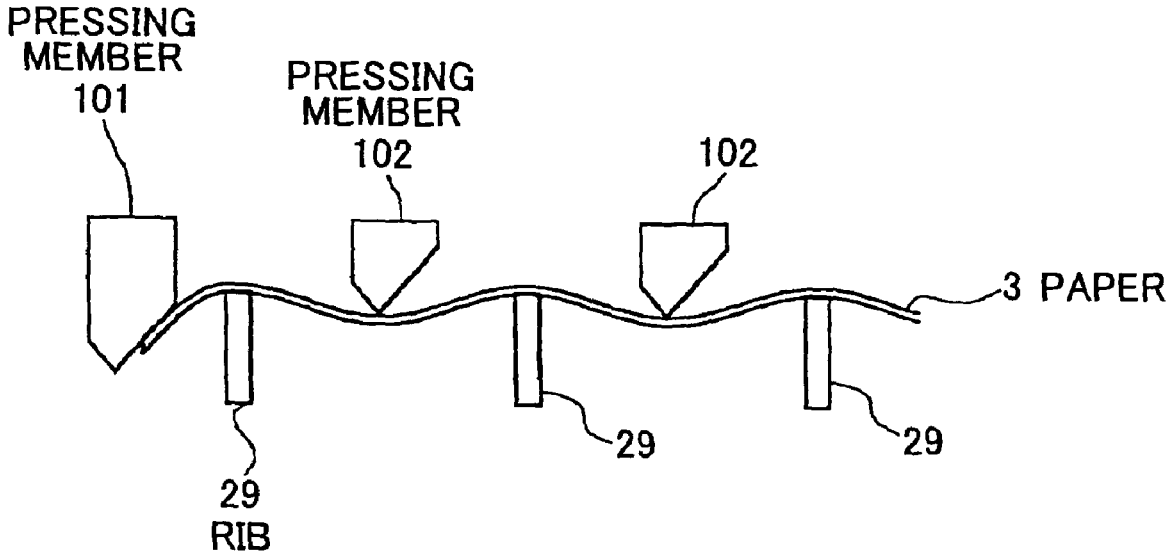
FIG. 4 is a front view of pressing members and the vicinity thereof in the ink-jet recording apparatus according to the embodiment of the present invention.

Referring to FIG. 2, the print receiving member 27 is detailed hereinafter. FIG. 2 is a schematic perspective view of the print receiving member 27 and the vicinity thereof in the ink-jet recording apparatus 1 according to this embodiment of the present invention. FIG. 3 is a plan view of the print receiving member 27 of the ink-jet recording apparatus 1 according to this embodiment of the present invention. FIG. 4 is a front view of pressing members 101, 102 and the vicinity thereof in the ink-jet recording apparatus 1 according to this embodiment of the present invention.

Referring to FIG. 2, the print receiving member 27 is provided with plural ribs (supporting members) 29. The ribs 29 are arranged so as to define a predetermined gap between the paper 3 and the recording head 14. As shown in FIG. 2, the outermost ribs of the plural ribs 29 are positioned slightly inside the side edge of the paper 3. Preferably, the distance between each of the outermost ribs 29 and the corresponding side edge of the paper 3 is less than or equal to 10 mm. More preferably, the distance therebetween is less than or equal to 5 mm. An attachment portion 28 is provided with the plural pressing members 101, 102, which are discussed in detail below.

The paper 3 conveyed to the print receiving member 27 is pressed downward by the pressing members 101, 102 and conveyed on and along the ribs 29 disposed on the print receiving member 27. In this manner, a predetermined gap between the paper 3 and the print head 14 is defined. Onto the paper 3 are adhered ink droplets ejected from the print head 14 and thus a predetermined image is formed thereon.

Among the plural pressing members 101, 102, the outermost pressing members 101 (first and second paper pressing members) on both sides can press respective side portions of the paper 3 downward. This allows the side portions of the paper 3 to be bent downwardly in areas outside the outermost ribs 29 (see FIG. 4), thereby preventing the side portions from rising. By the way, a "side portion" here should be understood as being an area near the paper edge extending along the paper conveying direction.

In addition, due to such bending of the paper 3 in both side portions, the paper 3 can be maintained flat even between two adjacent ribs, therefore maintaining constant the gap between the paper 3 and the recording head 14. Moreover, the paper 3 is prevented from contacting the recording head 14 even if the paper 3 swells after absorbing ink droplets, thereby preventing the image thereon from being degraded and the recording head 14 from being damaged.

As stated above, due to a simple configuration of the plural ribs 29 disposed on the print receiving member 27 so as to oppose the recording head 14, the pressing members 101 disposed so as to press the side portions of the paper 3 downward, and the pressing members 102 arranged between every two adjacent ribs in this non-limiting embodiment, the paper 3 is prevented from contacting the recording head 14.

[Pressing Member]

Next, the pressing members 101, 102 attached to the attachment portion 28 are described in detail. Each of pressing members 101, 102 according to this embodiment is attached to the attachment portion 28 at the upstream side (or "A" side in FIG. 3) of the print receiving member 27 and extends toward the downstream side (or "B" side in FIG. 3), as shown in FIG. 3. Particularly, the pressing members 101 are arranged outside the outmost ribs 29, thereby preventing the side portions of the paper 3 from rising, as described above.

In addition, since the pressing members 101 are arranged in a symmetric relationship with each other as shown in FIG. 3, the paper 3 is prevented from rising to a substantially equal degree in both side portions.

By the way, when a paper having a smaller width than the paper 3 illustrated in FIG. 3 is conveyed, other pressing members (i.e., pressing members 102) positioned inside the pressing members 101 can press the side portions of the paper downward. For example, the pressing members 102 (a third paper pressing member) can press downward on the side portions of the paper illustrated by a dotted line in FIG. 3. Therefore, the narrower paper can also be prevented from rising upward in both side portions.

Figure 8:
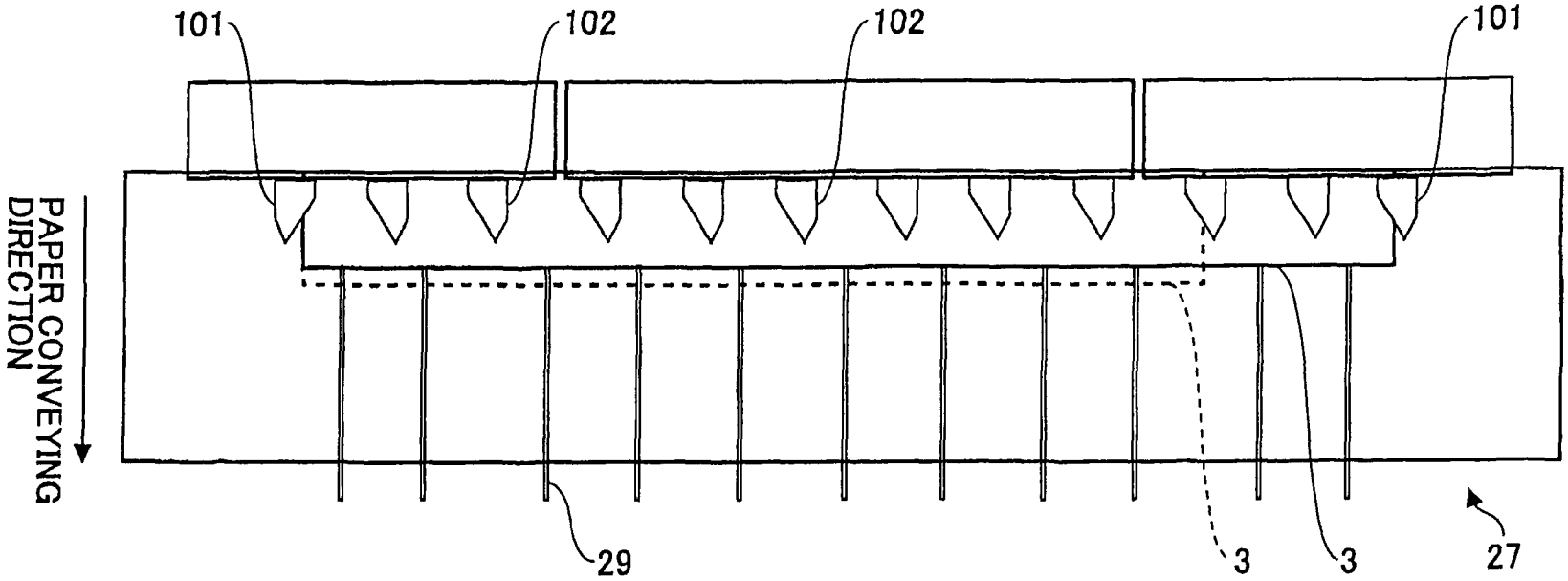
FIG. 8 is a plan view of the print receiving member in which the pressing members are disposed differently from the pressing members in FIG. 3.

By the way, the pressing members 101, 102 shown in FIG. 3 are arranged symmetrically in relation to a central point of the print receiving member 27, since the paper rests on the print receiving member 27 so that the center of the paper coincides with the central point of the receiving member 27. In contrast, the pressing members 101, 102 may be arranged asymmetrically as shown in FIG. 8, which is suitable when the paper is left-aligned. Specifically, when the paper 3 shown by a dotted line in FIG. 8, which is narrower than the paper 3 shown by a solid line, is conveyed therein, the right edge of the narrower paper can be pressed downward by either one of the pressing members 102.

Figure 5:
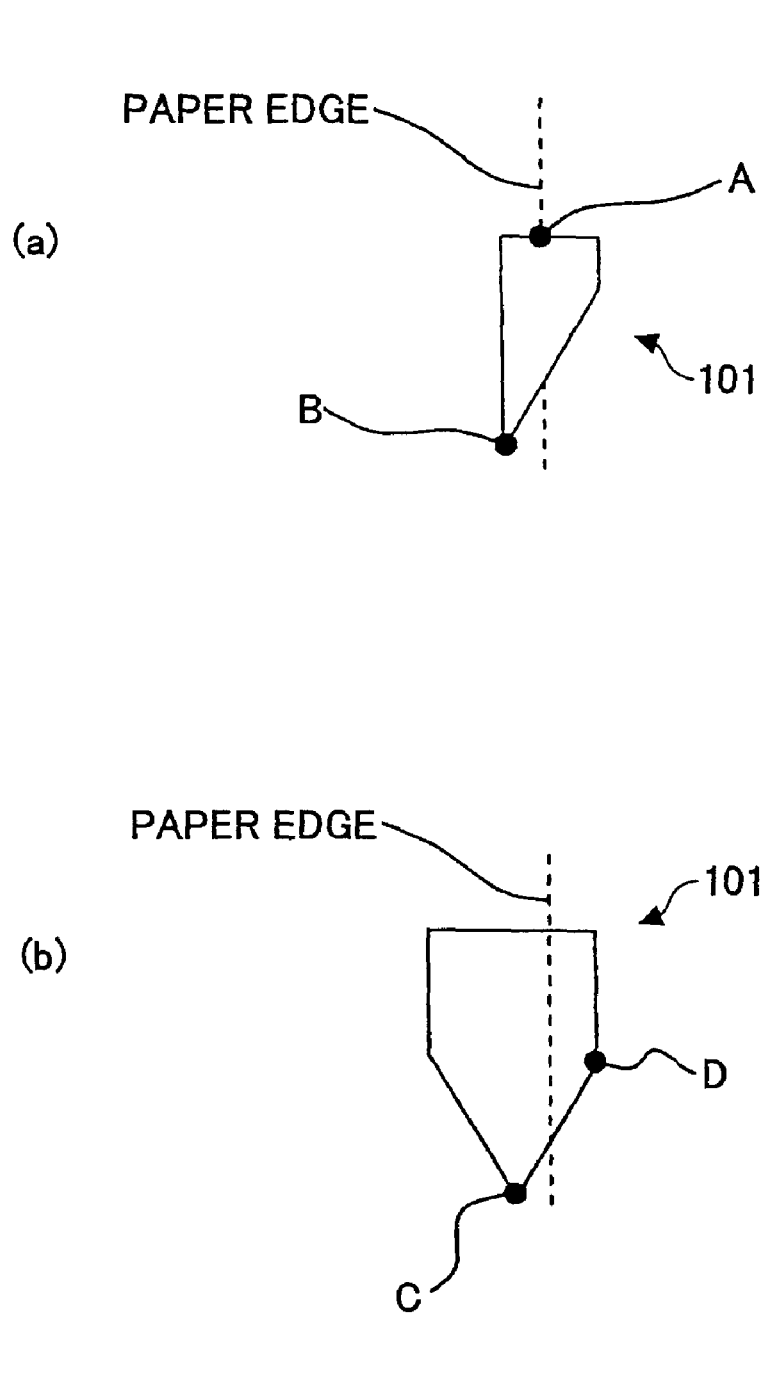
FIGS. 5(*a*) and 5(*b*) show other examples of the pressing members having different shapes.

FIGS. 5(*a*) and 5(*b*) show additional examples of the pressing member 101 according to this embodiment of the present invention. As shown in FIG. 5(*a*), the pressing member 101 has a distal point B which is a downward point in the paper conveying direction. The distal point B lies outward (leftward in FIG. 5(*a*)) and downstream from a center point A on the upstream side of the pressing member 101.

Additionally, the distal point B is disposed outside the edge (dotted line) of the paper. Moreover, not only the distal point B but at least a portion on the downstream side thereof is also disposed outside the edge of the paper.

As shown in FIG. 5(*b*), the pressing member 101 as the other example has a distal point C that lies outward (leftward in FIG. 5(*b*)) and downstream from a corner point D on the upstream side thereof.

Figure 6:
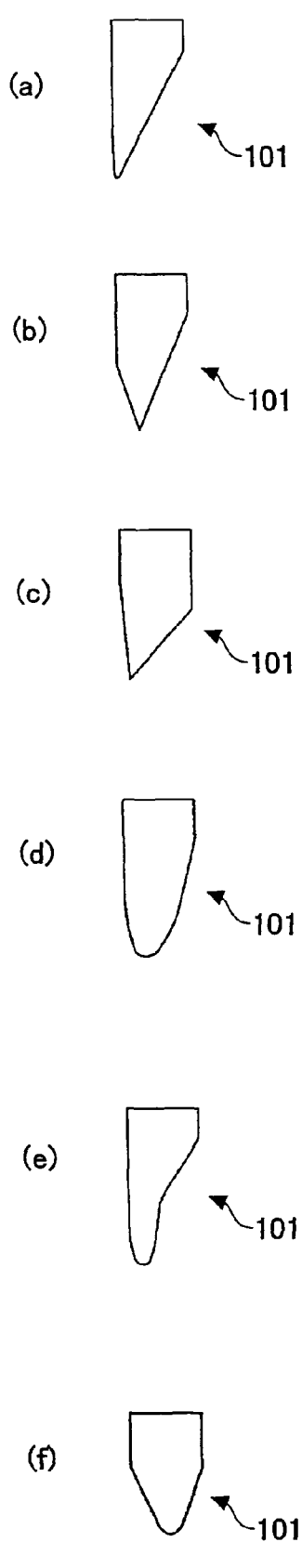
FIGS. 6(*a*) through 6(*f*) show still other examples of the pressing members having different shapes.

FIGS. 6(*a*) through 6(*f*) show still other examples of the pressing member 101. All the pressing members 101 illustrated therein are disposed so as to press the left side portion of the paper downward.

The pressing members 101 having such shapes as illustrated in FIGS. 5(*a*), 5(*b*), and 6(*a*) through 6(*f*) can apply a greater pressing force to the side portion of the paper as the paper proceeds downward, thereby assuredly preventing the side portion of the paper from rising upward.

Moreover, even when the side portion of the paper shifts slightly in the direction transverse to the paper conveying direction, the edge of the paper can touch the pressing member 101 and be pressed downward. Therefore, the side portion of the paper 3 can be bent downward by a weaker pressing force.

Furthermore, since the side portion of the paper, which is easily bent or warped upward, can be pressed downward, the paper is prevented from being contaminated or jammed.

In addition, since the pressing member 101 is narrower in the downstream portion thereof than in the upstream portion thereof, the pressing member 101 can press the side portion of the paper downward with a weaker force, thereby allowing the paper to be kept flat as a whole and thus providing a better quality image. If the pressing force becomes too strong, the paper cannot be maintained flat, since the stronger force may cause the paper to drop between the ribs, which in turn makes it difficult to maintain the paper flat in relation to the recording head 14 (FIG. 1).

Additionally, the outmost ribs 29, which are disposed near the side portions of the paper, can help keep the paper flat, thereby providing a better quality image. Moreover, since the pressing members 101 are disposed outside the outmost ribs 29, the pressing members 101 can prevent the side portion of the paper from rising upward.

Figure 7:
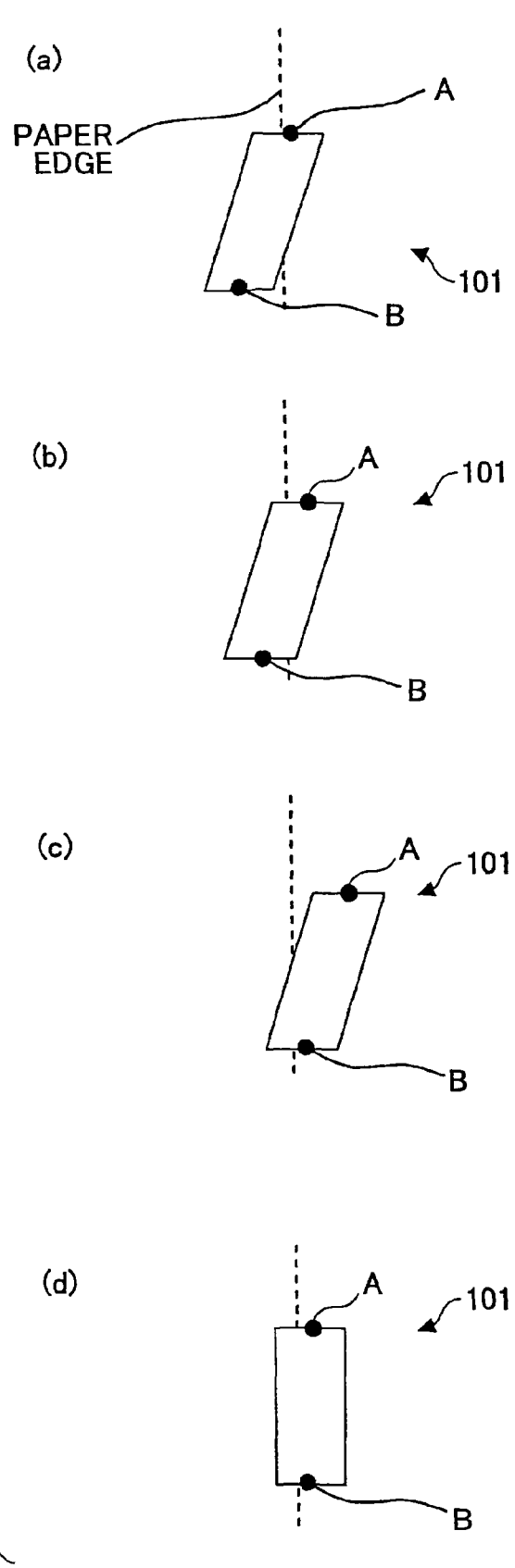
FIGS. 7(*a*) through 7(*d*) show still other examples of the pressing members having different shapes.

FIGS. 7(*a*) through 7(*d*) show various other examples of the pressing members 101. Specifically, FIGS. 7(*a*) through 7(*c*) show pressing members having identical widths along the paper conveying direction, which are different from the pressing members 101 illustrated in FIGS. 5(*a*), 5(*b*), and FIGS. 6(*a*) through 6(*f*).

More specifically, as shown in FIG. 7(*a*), the pressing member 101 is disposed so that a center point B at the rear (or downstream) end thereof lies outside the paper edge whereas a center point A at the front (or upstream) end thereof lies substantially above the paper edge shown by a dotted line.

In FIG. 7(*b*), the pressing member 101 is disposed so that the center point B at the rear (or downstream) end thereof lies outside the paper edge whereas the center point A at the front (or upstream) end thereof lies inside the paper edge.

In FIG. 7(*c*), the pressing member 101 is disposed so that the center points A and B lie inside the paper edge. Although not only the point A but also the point B lies inside the paper edge in this case, at least a portion of the pressing member 101 can extend outward from the paper edge. Therefore, this pressing member 101 can also press the paper edge downward.

In FIG. 7(*d*), the pressing member 101 has a rectangular shape and is disposed so that both the center point B at the rear (or downstream) end thereof and the center point A at the front (or upstream) end thereof lie substantially above the paper edge.

Even these pressing members 101 illustrated in FIGS. 7(*a*) through 7(*d*) can prevent the paper from rising upward evenly in both side portions of the paper when the pressing members 101 are disposed on both sides of the print receiving member 27. In addition, such pressing members 101 can prevent the side portions of the narrower paper from rising upward.

[Pressing Amount Limiting Member]

Next, a pressing amount limiting member according to one embodiment of the present invention is described. In the foregoing embodiments, the pressing members 101 press the paper outside the outmost ribs 29 downward. In addition, since plural pressing members 102 are disposed on the inner side of the pressing members 101, even when narrower paper is used, the paper can be bent downward on both side portions (see FIG. 3).

However, the plural pressing members 102 may press the paper downward to a greater extent between all adjacent ribs 29, which may cause the paper, which has to be kept flat in relation to the recording head 14, to be unnecessarily bent. In order to prevent such unnecessary bending, a pressing amount limiting member 30 is provided in this embodiment. That is, an amount of pressing on the paper caused by the pressing members 102 can be adjusted by adjusting the elevation of the pressing amount limiting member 30.

The pressing amount limiting member 30 is disposed on the print receiving member 27. Specifically, the pressing amount limiting member 30 may be disposed in three positions in relation to the pressing members 101, 102 as shown in FIGS. 9(*a*) through 9(*c*), although the position cannot be strictly limited to the three positions as long as the pressing amount limiting member 30 can restrict the amount of pressing the paper 3 caused by the pressing members 102.

Figure 9:
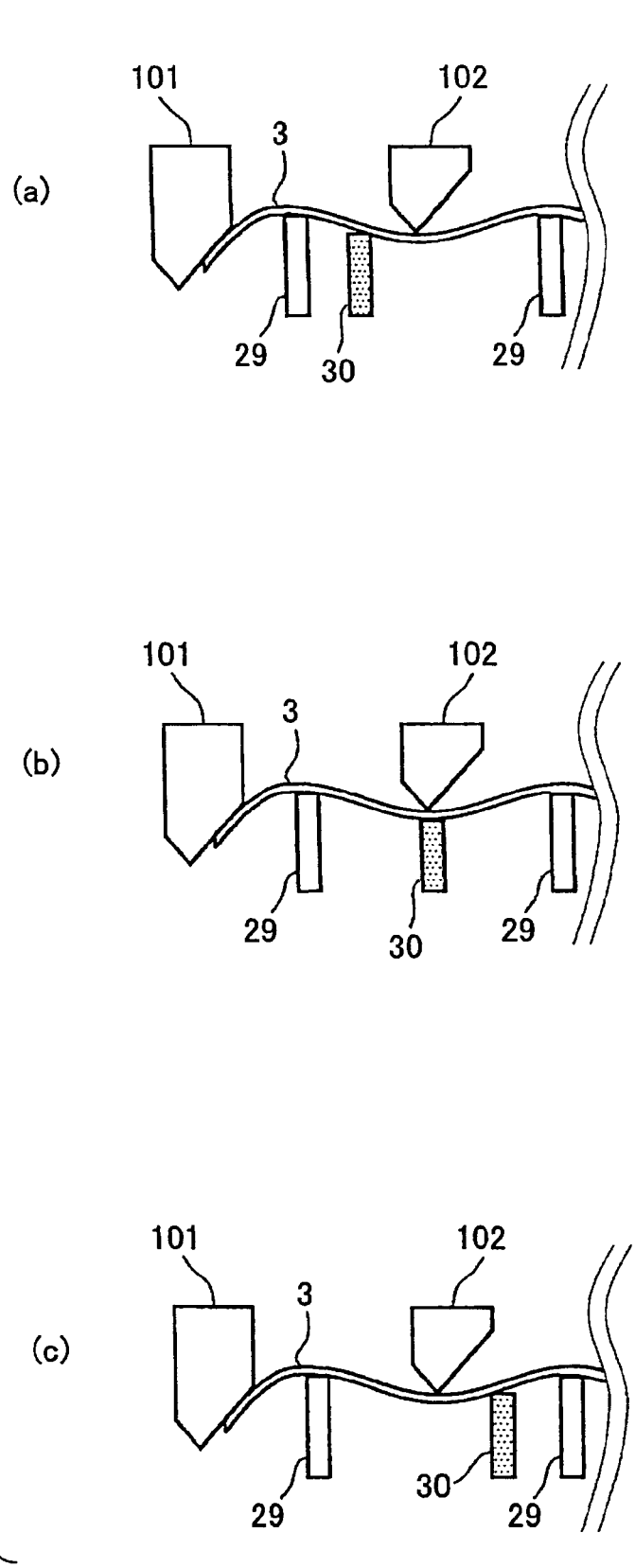
FIGS. 9(*a*) through 9(*c*) are front views of the pressing amount limiting members disposed in three respective positions in relation to the pressing members.

In FIG. 9(*a*), the pressing amount limiting member 30 is disposed outside (or on the left-hand side of) the pressing member 102 between the ribs 29. In FIG. 9(*a*), the pressing amount limiting member 30 is disposed below the pressing member 102. In other words, the pressing amount limiting member 30 is disposed so that a portion of the paper pressed downward by the pressing member 102 is held by the pressing amount limiting member 30. In FIG. 9(*c*), the pressing amount limiting member 30 is disposed inside (or on the right-hand side of) the pressing member 102 between the ribs 29. The pressing amount limiting members 30 disposed as shown in FIGS. 9(*a*) through 9(*c*) are discussed in detail hereinafter.

Figure 10:
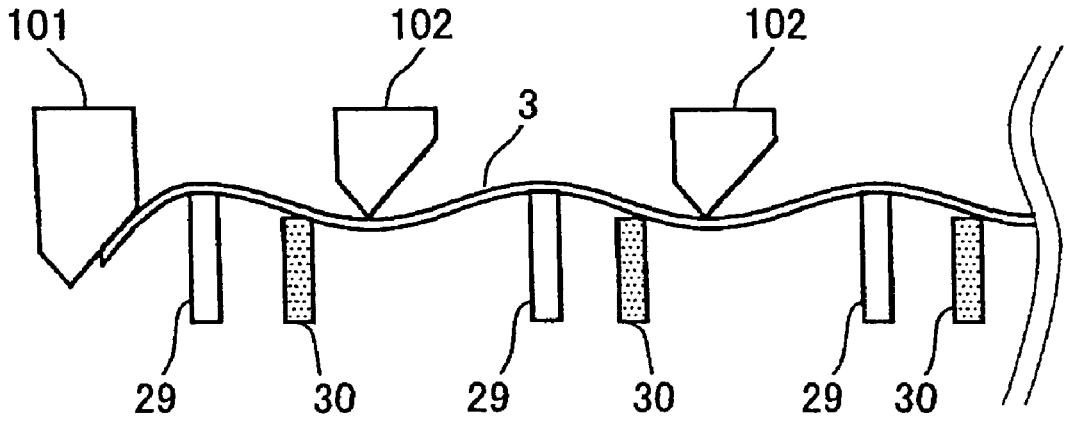
FIG. 10 is a front view of the pressing amount limiting members disposed outside the corresponding one of the pressing members.
Figure 11:
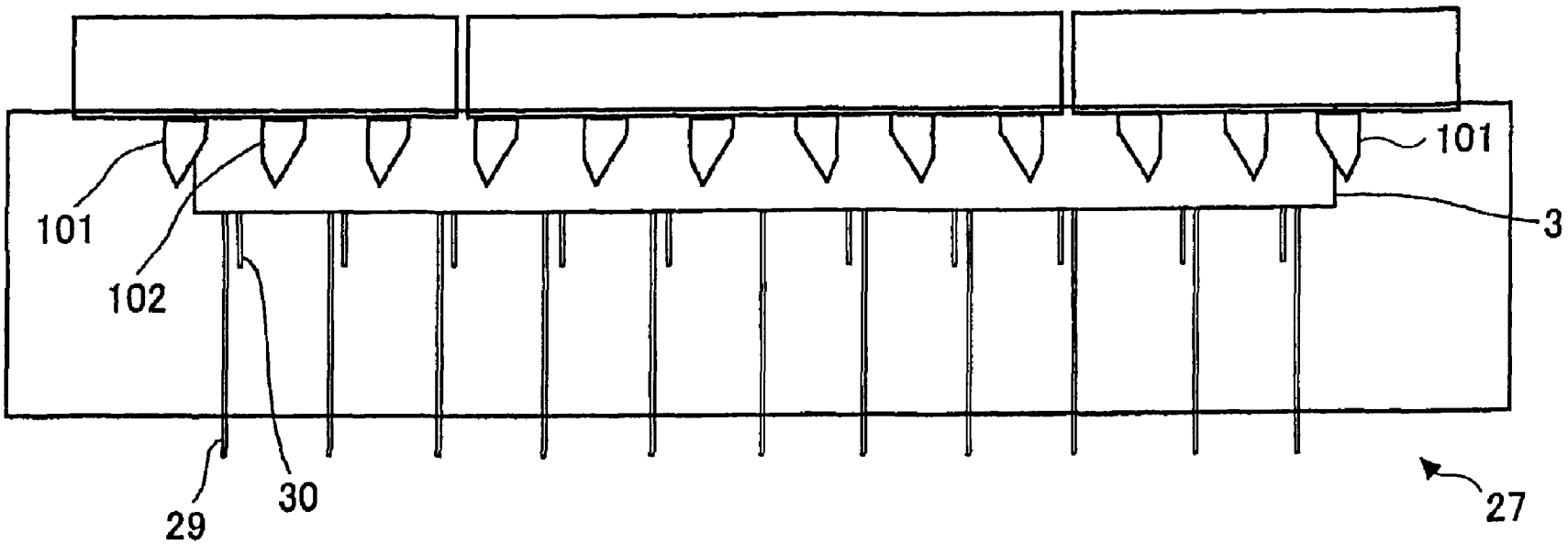
FIG. 11 is a plan view of the print receiving member in which each of the pressing amount limiting members is disposed outside the corresponding one of the pressing members.

First, the pressing amount limiting member 30 disposed outside the pressing member 102 is described with reference to FIGS. 9(*a*), 10, and 11. FIG. 10 is an explanatory view showing that each of additional pressing amount limiting members 30 is disposed outside the corresponding one of the pressing members 102. FIG. 11 is a plan view of the print receiving member 27 in which each of the additional pressing amount limiting members 30 is disposed outside the corresponding one of the pressing members 102. It should be understood from FIGS. 10 and 11 that a rib 29, a pressing amount limiting member 30, and a third paper pressing member 102 are disposed in this order in a direction from the side edge to the center of the paper 3. The amount of pressing the paper 3 caused by the pressing members 102 can be adjusted by adjusting the elevation of the pressing amount limiting members 30 so disposed.

As shown in FIG. 10, the pressing amount limiting members 30 have a lower height (vertical length) than the ribs 29. In other words, the pressing amount limiting members 30 are not required to have a height higher than or equal to the ribs 29 because the pressing amount limiting members 30 are not configured to adjust the gap between the paper 3 and the recording head 14, whereas the ribs 29 disposed on the print receiving member 27 are configured to define the gap. In addition, the height of the pressing amount limiting members 30 is not limited to a particular value as long as the pressing amount limiting members 30 can limit the amount of pressing the paper 3 caused by the pressing members 102.

Figure 12:
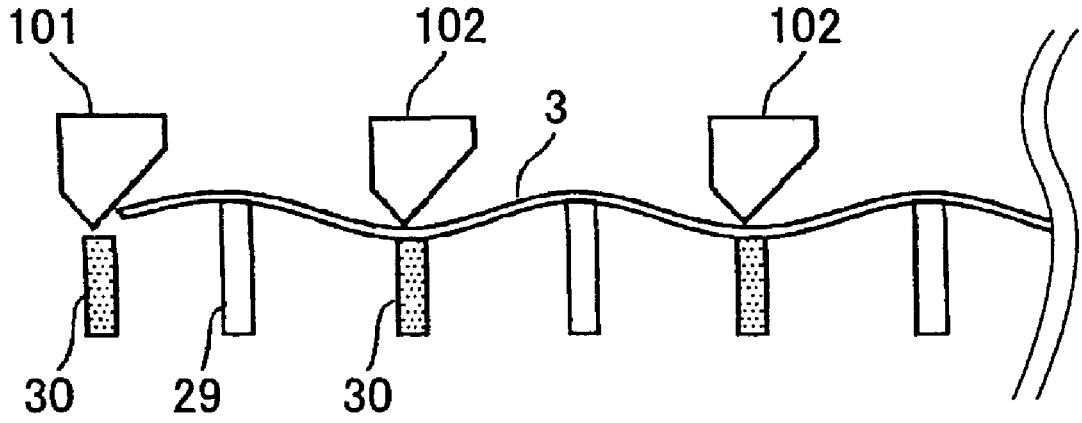
FIG. 12 is a front view of the pressing amount limiting members disposed below the corresponding pressing members.
Figure 13:
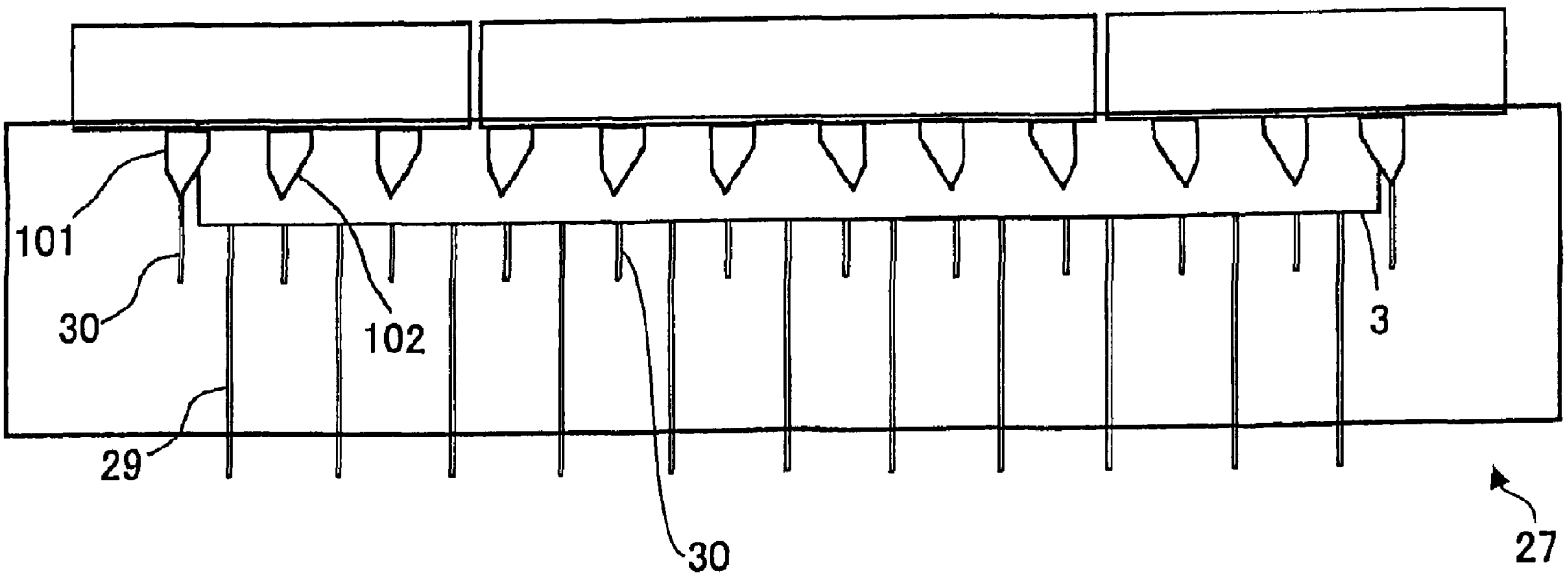
FIG. 13 is a plan view of the print receiving member in which the pressing amount limiting members are disposed below the corresponding pressing members.
Figure 14:
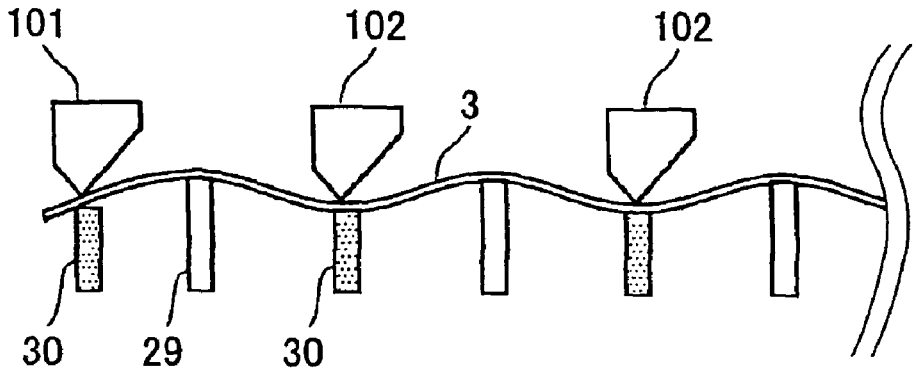
FIG. 14 is a front view for depicting that a sheet of paper which has the edge thereof extending beyond the pressing member is dealt with by the pressing members and the pressing amount limiting members.

Next, the pressing amount limiting member 30 disposed below the pressing member 102 is described with reference to FIGS. 9(*b*), and 12 through 16. FIG. 12 is another explanatory view showing that additional pressing amount limiting members 30 are disposed below the respective pressing members 102. FIG. 13 is a plan view of the print receiving member 27 in which the additional pressing amount limiting members 30 are disposed below the respective pressing members 102. Additionally, FIG. 14 shows a situation where the paper 3 is wider and the paper edge thereof extends beyond the pressing member 101. The amount of pressing the paper 3 caused by the pressing members 102 can be adjusted by adjusting the elevation of the pressing amount limiting members 30 so disposed.

Figure 15:
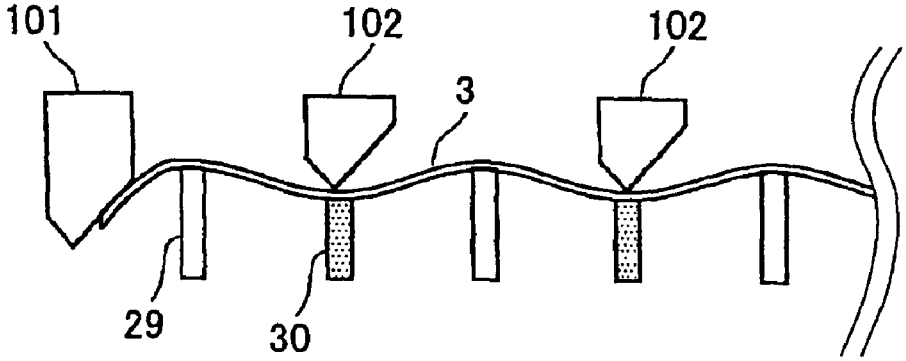
FIG. 15 is another front view of the pressing amount limiting members disposed below the corresponding pressing members except for the outmost (leftmost) pressing member.
Figure 16:
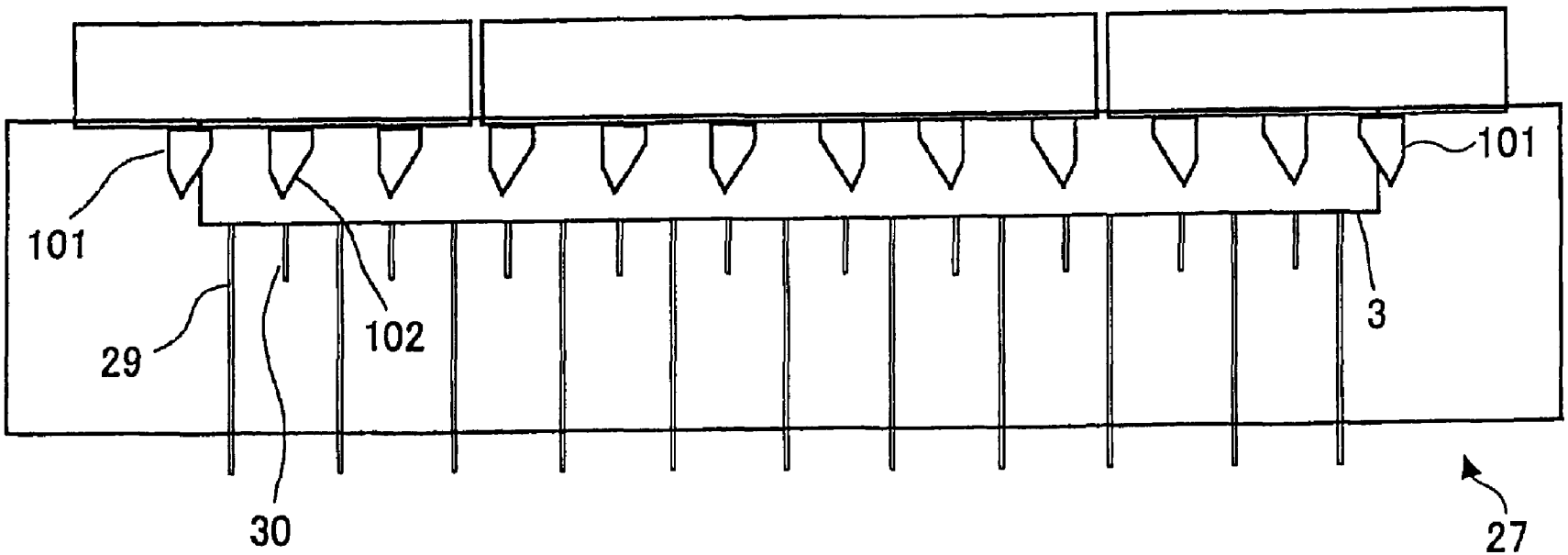
FIG. 16 is another plan view of the print receiving member in which the pressing amount limiting members disposed below the corresponding pressing members except for the outmost (leftmost) pressing member.

Although FIGS. 12 through 14 each shows an additional pressing amount limiting member 30 disposed below the pressing member 101, such a pressing amount limiting member 30 is not always necessary as shown in FIGS. 15 and 16. Even in these cases, the side portion of the paper 3 can be pressed downward by the pressing member 101, and the paper 3 can be kept flat in relation to the recording head 14 (FIG. 1) since the amount of pressing the paper 3 caused by the pressing members 102 can be limited by the pressing amount limiting members 30 below the pressing members 102.

Figure 17:
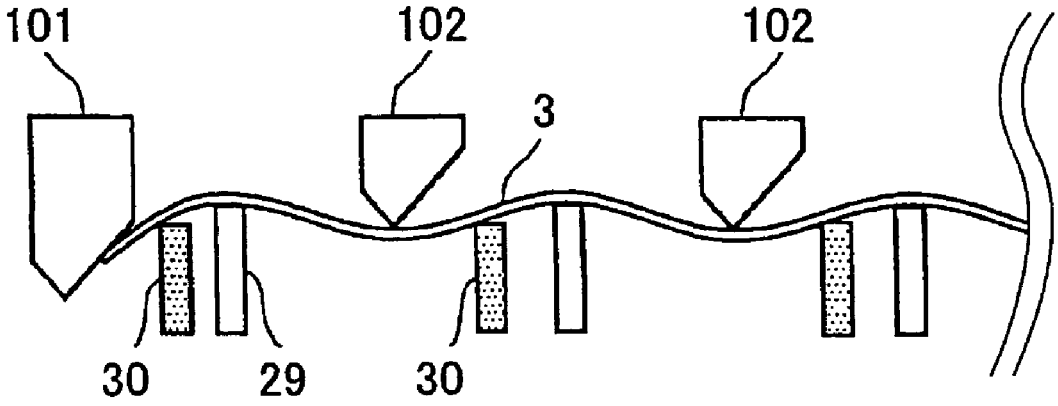
FIG. 17 is a front view of the pressing amount limiting members are disposed inside the corresponding one of the pressing members.

Then, the pressing amount limiting member 30 disposed inside (or on the right-hand side of) the pressing member 102 is described with reference to FIGS. 17 through 20 as well as FIG. 9(*c*). FIG. 17 is an explanatory view showing that each of the additional pressing amount limiting members 30 is disposed inside the corresponding one of the pressing members 102. FIG. 17 is a plan view of the print receiving member 27 in which each of the additional pressing amount limiting members 30 is disposed inside the corresponding one of the pressing members 102. It should be understood from FIGS. 17 and 18 that a rib 29, a third pressing member 102, and a pressing amount limiting member 30 are disposed in this order in a direction from the side edge to the center of the paper 3. The amount of pressing the paper 3 caused by the pressing members 102 can be adjusted by adjusting the elevation of the pressing amount limiting members 30 so disposed.

Figure 18:
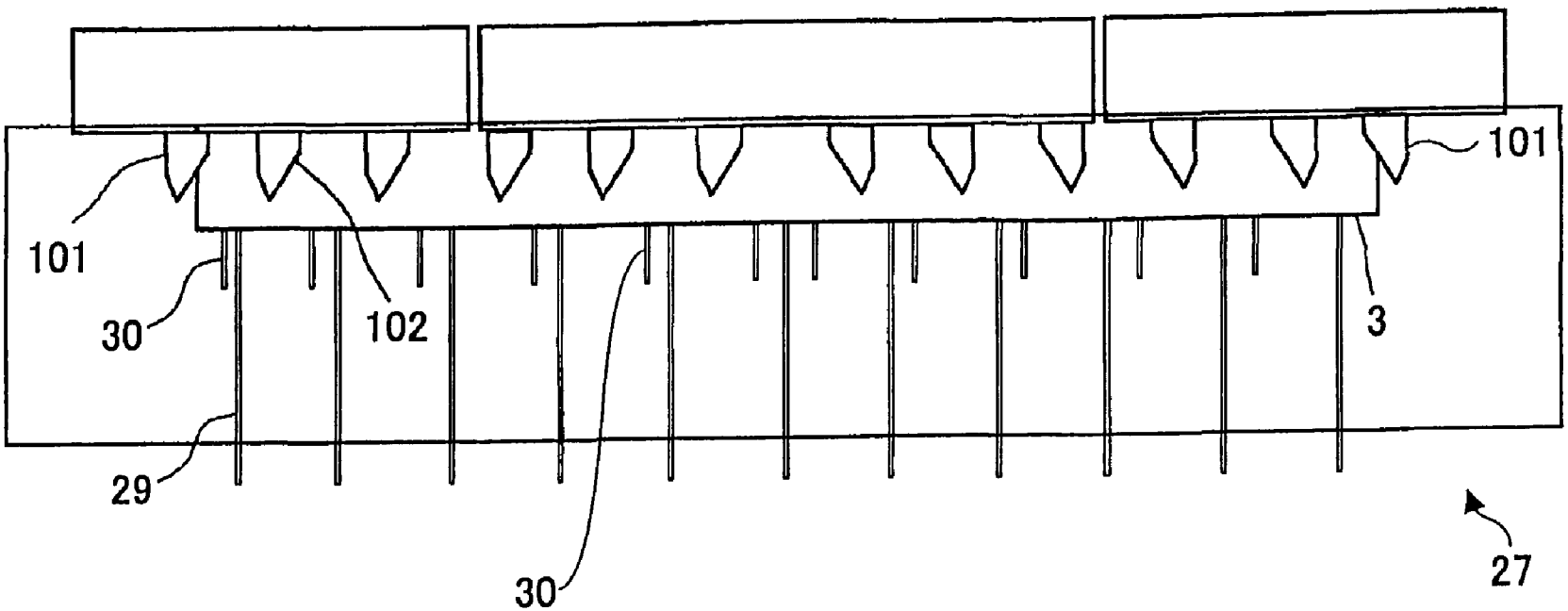
FIG. 18 is a plan view of the print receiving member in which the pressing amount limiting members are disposed inside the corresponding one of the pressing members.
Figure 19:
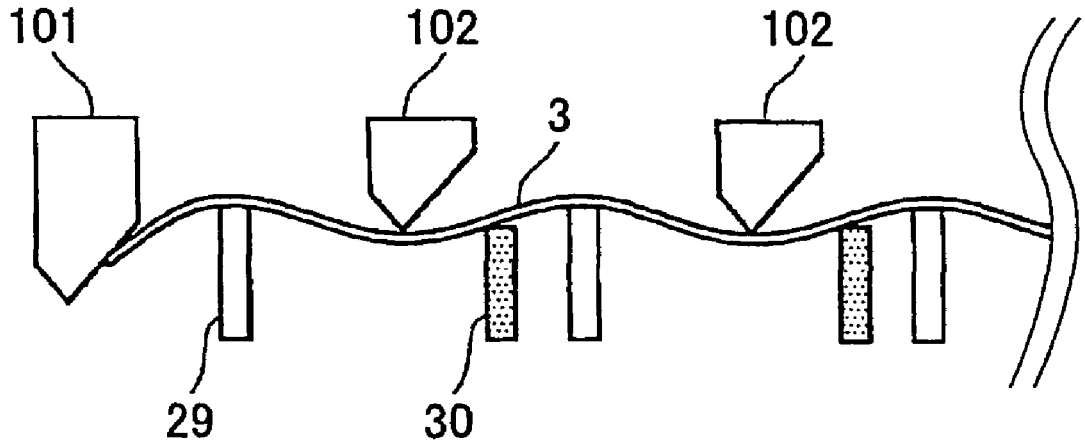
FIG. 19 is another front view of the pressing amount limiting members disposed inside the corresponding one of the pressing members except for the outmost (leftmost) pressing member.
Figure 20:
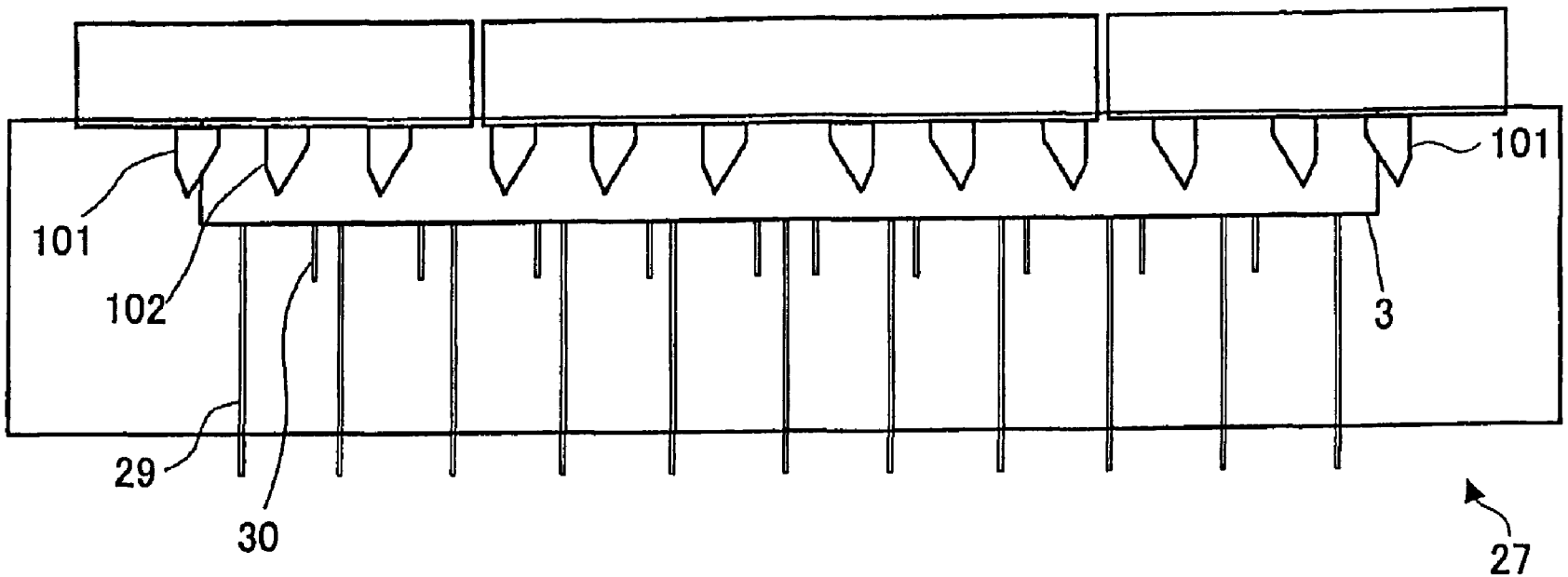
FIG. 20 is another plan view of the print receiving member in which the pressing amount limiting members are disposed inside the corresponding one of the pressing members except for the outmost (leftmost) pressing member.

Although FIGS. 17 and 18 show a pressing amount limiting member 30 disposed between the pressing member 101 and the outermost rib 29, such a pressing amount limiting member 30 is not always necessary as shown in FIGS. 19 and 20. In these cases, the pressing member 101 can press the side portion of the paper 3 downward. Besides, the amount of pressing the paper 3 caused by the pressing members 102 can be limited by the pressing amount limiting members 30 disposed inside the pressing members 102, so that the paper 3 is kept flat in relation to the recording head 14.

Figure 21:
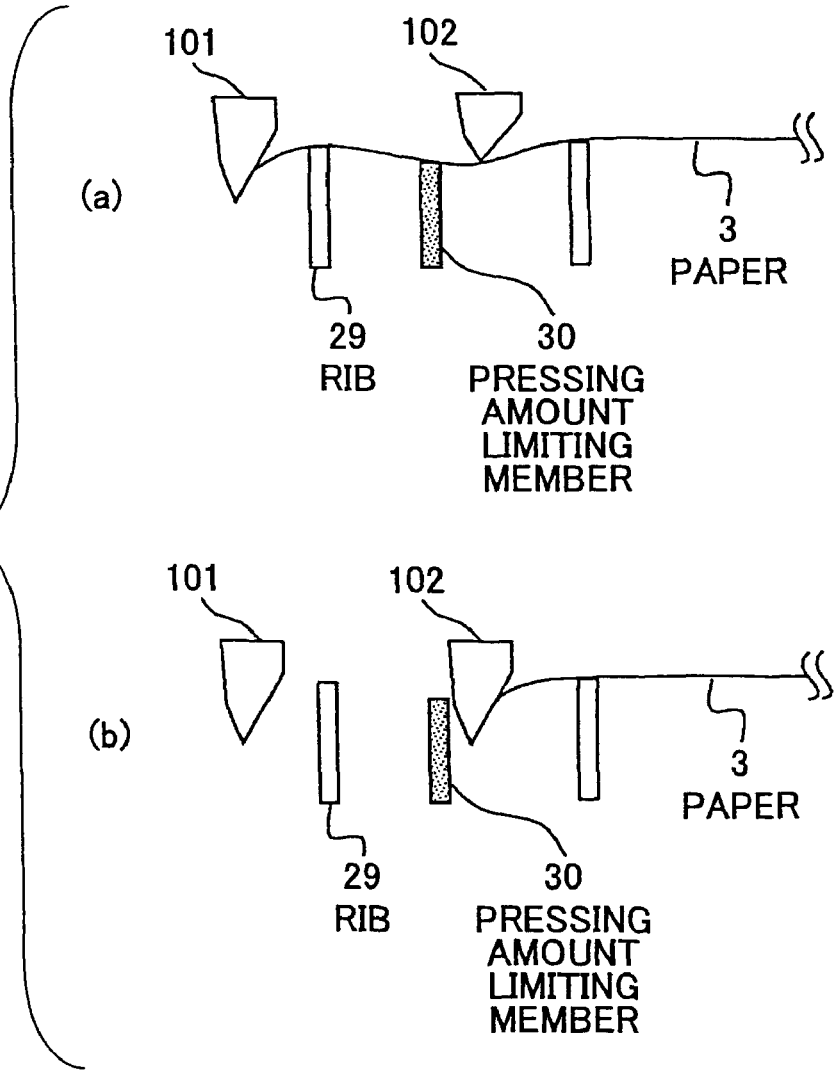
FIGS. 21(*a*) and 21(*b*) are schematic side views for explaining how the pressing members and the pressing amount limiting member may function differently depending on the size of the paper.

Referring to FIGS. 21(*a*) and 21(*b*), it is next described how the pressing members 101, 102 and the pressing amount limiting member 30 may function differently depending on the size of the paper 3.

FIG. 21(*a*) is an explanatory view showing how the pressing amount limiting member 30 functions to limit the amount of pressing the paper 3 caused by the pressing member 102 when a sheet of paper 3 larger than the paper which the pressing member 102 is supposed to press downward is conveyed therein. In this case, the side portion of the larger paper 3 is pressed downward by not the pressing member 102 but the pressing member 101 in order to prevent the side portion from rising; and the print area of the larger paper 3 is kept flat in relation to the recording head 14 (FIG. 1) by the pressing member 102 and the pressing amount limiting member 30 that limits the amount of pressing on the larger paper 3 caused by the pressing member 102, thereby providing a better quality image thereon.

On the other hand, when a sheet of paper 3 that is narrower than the paper 3 illustrated in FIG. 21(*a*) is conveyed to the print receiving member 27 (FIG. 11) as shown in FIG. 21(*b*), the narrower paper 3 can be pressed downward by the pressing member 102. In this case, a relatively large area of the side portion of the paper 3 may be pressed downward by the pressing member 102, since no image is printed on the side portion.

In addition, it can be contemplated as other embodiments according to the present invention that plural pressing amount limiting members X are disposed outside the corresponding pressing members 102 and plural pressing amount limiting members Y below the corresponding pressing members 101, 102.

Figure 22:
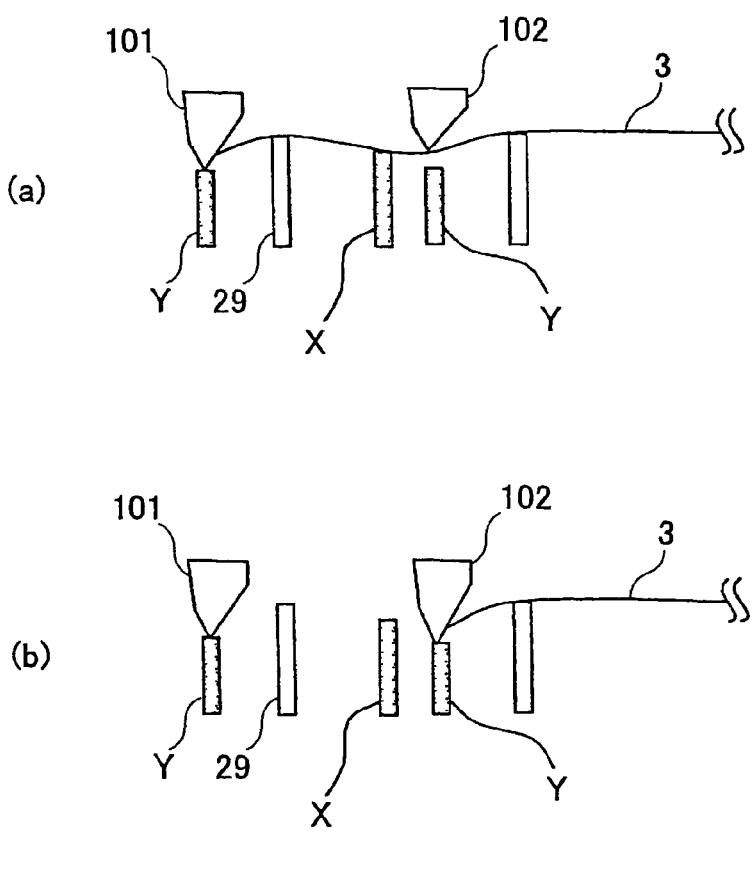
FIGS. 22(*a*) and 22(*b*) are schematic side views illustrating that two pressing amount limiting members are arranged between the pressing members.

The pressing amount limiting members X function to limit the amount of pressing the paper 3 caused by the associated pressing members 102 when the edge of the paper 3 reaches the pressing member 101 (see FIG. 22(*a*)). Thus, the paper 3 can be kept flat in relation to the recording head 14 (FIG. 1) in an area in which the pressing amount limiting member X limits the pressing amount, for better print quality. In addition to the pressing amount limiting members X, the pressing amount limiting members Y can demonstrate a pressing amount limiting effect by adjusting the elevation thereof. Therefore, the paper 3 can be kept flat in relation to the recording head 14 (FIG. 1).

On the other hand, when a narrower paper whose edge does not reach the pressing member 101 is conveyed therein, the pressing amount limiting member Y disposed below the associated pressing member 102 that presses the side portion of the paper 3 downward can limit the amount of pressing the paper 3 caused by the pressing member 102. In addition, adjusting the elevation of the pressing amount limiting members (i.e., 30, X, Y) can reduce or increase the limiting amount caused by the pressing members 102.

As stated above, according to this embodiment in which the plural pressing amount limiting members 30, X, Y are provided, the pressing amount limiting effect can be appropriately exhibited depending on user needs.

By the way, the present invention is not limited to the embodiments specifically disclosed herein, but various alterations and modifications may be applied without departing from the scope of the invention set forth in accompanying claims.

The present application is based on Japanese Patent Applications No. 2006-146861, filed on May 26, 2006, and No. 2007-065640, filed on Mar. 14, 2007 with the Japanese Patent Office, the entire contents of which are hereby incorporated by reference.

The invention claimed is:

1. An image forming apparatus comprising;

a sheet of paper having a predetermined width;

a recording unit that forms an image on the sheet of paper having the predetermined width;

a guiding member that is disposed below the recording unit and that includes first area through which the sheet of paper passes and second areas through which the sheet of paper does not pass, the second areas being disposed relative to the first area along a width direction orthogonal to a paper conveying direction of the sheet of paper, the first area having a width corresponding to the predetermined width of the sheet of paper, and the guiding member guiding the sheet of paper along the first area of the guiding member;

an attachment member arranged at an upstream position relative to the recording unit along the paper conveying direction; and a pair of first paper pressing members, wherein each first paper pressing member of the pair is attached to the attachment member and extends downstream along the paper conveying direction, and positively presses the sheet of paper in a translational direction, that is orthogonal to the paper conveying direction and to the width direction, toward the guiding member, and wherein said each first paper pressing member has a first point located distal relative to the attachment member, and has a second point located upstream relative to the first point along the paper conveying direction so that an edge connecting the first point and the second point obliquely traverses a corresponding boundary between the first area of the guiding member and a corresponding second area of the second areas of the guiding member, from the first area to the second area along the paper conveying direction.

2. The image forming apparatus of claim 1, wherein the first paper pressing member is disposed so that a downstream portion of the first paper pressing member along the paper conveying direction lies outward in a direction transverse to the paper conveying direction from an upstream portion of the first paper pressing member.

3. The image forming apparatus of claim 1, wherein the first paper pressing member is disposed so that a center of a downstream portion of the first paper pressing member along the paper conveying direction lies outward in a direction transverse to the paper conveying direction from a center of an upstream portion of the first paper pressing member.

4. The image forming apparatus of claim 1, wherein the first paper pressing member is disposed so that a center of a downstream portion of the first paper pressing member along the paper conveying direction lies over the second area of the guiding member.

5. The image forming apparatus of claim 1, wherein the first paper pressing member is disposed so that a middle portion of the first paper pressing member between a downstream portion of the first paper pressing member and an upstream portion of the first paper pressing member along the paper conveying direction lies over the second area of the guiding member.

6. The image forming apparatus of claim 1, wherein the first paper pressing member becomes narrower toward a downstream end of the first paper pressing member along the paper conveying direction.

7. The image forming apparatus of claim 1, further including one or more supporting members that support the sheet of paper from below.

8. The image forming apparatus of claim 1, wherein a first edge of the first paper pressing member on an outward side of the first paper pressing member in a direction transverse to the paper conveying direction, is shorter than a second edge of the first paper pressing member on an inward side of the first paper pressing member in the direction transverse to the paper conveying direction.

9. The image forming apparatus of claim 1, further including:

a second paper pressing member that presses another side portion of the sheet of paper; and one or more third paper pressing members positioned between the first and second paper pressing members and capable of pressing the sheet of paper between the first and the second paper pressing members.

10. The image forming apparatus of claim 9, wherein at least one of the first, the second, and the third paper pressing members presses the sheet of paper on the guiding member.

11. The image forming apparatus of claim 9, wherein any one of the first or the second paper pressing member presses one of the side portions of the sheet of paper and one of the one or more third paper pressing members presses the other of the side portions of the sheet of paper, and wherein the one of the one or more third paper pressing members is disposed symmetrically with said any one of the first or the second paper pressing member in relation to the paper conveying direction.

12. The image forming apparatus of claim 9, further including one or more paper pressing amount limiting members disposed below w sheet of paper and configured to be substantially vertically movable so as to limit an amount of pressing on the sheet of paper caused by the first paper pressing member, the second paper pressing member, the third paper pressing member, or a combination thereof.

13. The image forming apparatus of claim 12, further including one or more supporting members configured to support the sheet of paper from below, wherein the one or more paper pressing amount limiting members push from below the sheet of paper that is held from below by the supporting member and pressed from above by the first paper pressing members, the second paper pressing member, or the third paper pressing member, or a combination thereof, so as to limit the amount of pressing from above.

14. The image forming apparatus of claim 12, wherein at least one of the one or more paper pressing amount limiting members is disposed outward in a direction transverse to the paper conveying direction from the first area of the guiding member.

15. The image forming apparatus of claim 12, wherein a first set of the one or more paper pressing amount limiting members is disposed below the corresponding third paper pressing members, and wherein a second set of the one or more paper pressing amount limiting members is disposed between every adjacent two of the third paper pressing members.

16. The image forming apparatus of claim 12, wherein each of the one or more paper pressing amount limiting members is disposed below a corresponding one of the one or more third paper pressing members.

17. The image forming apparatus of claim 12, wherein one of the one or more paper pressing amount limiting members is disposed between the first paper pressing member and the third paper pressing member adjacent to the first paper pressing member.

18. The image forming apparatus of claim 12, wherein one of the one or more paper pressing amount limiting members is disposed between the second paper pressing member and the third paper pressing member adjacent to the second paper pressing member.

19. An image forming apparatus comprising:

a sheet of paper having a predetermined width;

a recording unit that forms an image on the sheet of paper having the predetermined width;

a guiding member that is disposed below the recording unit and that includes first area through which the sheet of paper passes and second areas through which the sheet of paper does not pass, the second areas being disposed relative to the first area along a width direction orthogonal to a paper conveying direction of the sheet of paper, the first area having a width corresponding to the predetermined width of the sheet of paper, and the guiding member guiding the sheet of paper along the first area of the guiding member;

an attachment member arranged at an upstream position relative to the recording unit along the paper conveying direction;

a first paper pressing members, wherein each first paper pressing member of the pair is attached to the attachment member and extends downstream along the paper conveying direction, and positively presses the sheet of paper in a translational direction, that is orthogonal to the paper conveying direction and to the width direction, toward the guiding member, and wherein said each first paper pressing member includes an inner edge, outer edge, an angled edge and a distal point located distal relative to the attachment member, the angled edge connects the distal point and the inner edge, and the angled edge connecting the distal point and the inner edge obliquely traverses a corresponding boundary between the first area of the guiding member and a corresponding second area of the second areas of the guiding member, from the first area to the second area along the paper conveying direction.

* * * * *